US007014264B2

(12) United States Patent
Alderman et al.

(10) Patent No.: US 7,014,264 B2
(45) Date of Patent: Mar. 21, 2006

(54) FOLDING CHAIR WITH PNUEMATICALLY HEIGHT ADJUSTABLE SEAT

(76) Inventors: Lee V. Alderman, 1617 Coronado Ave., Emporia, KS (US) 66801; Eric Albert Keen, 1916 Blue Hills Rd., Manhattan, KS (US) 66502

( * ) Notice: Subject to any disclaimer, the term of this patent is extended or adjusted under 35 U.S.C. 154(b) by 0 days.

(21) Appl. No.: 10/895,669

(22) Filed: Jul. 21, 2004

(65) Prior Publication Data

US 2006/0017312 A1 Jan. 26, 2006

(51) Int. Cl.
*A47C 1/02* (2006.01)
*A47C 1/12* (2006.01)
*A47C 4/00* (2006.01)

(52) U.S. Cl. ..... 297/344.19; 297/339; 297/55

(58) Field of Classification Search ..... 297/331, 297/339, 344.19, 55, 58, 338; 248/404; 108/116, 108/119, 120, 147
See application file for complete search history.

(56) References Cited

U.S. PATENT DOCUMENTS 1,428,018 A * 9/1922 Erickson ..... 297/332
2,381,574 A * 8/1945 Clarin ..... 297/58
3,256,036 A * 6/1966 Nolan ..... 297/16.1
3,999,733 A * 12/1976 Harder et al. ..... 248/631
4,148,523 A * 4/1979 Brand et al. ..... 297/55
4,309,057 A 1/1982 Lindley
4,538,853 A 9/1985 Levenberg
4,589,697 A 5/1986 Bauer et al.
5,046,781 A 9/1991 Ling
5,060,967 A * 10/1991 Hulterstrum ..... 280/650
5,178,025 A * 1/1993 Bennett et al. ..... 74/105
5,511,855 A 4/1996 Miles
5,609,390 A 3/1997 Takafuji
5,667,274 A 9/1997 Blackman
5,740,997 A 4/1998 Van Wieran
5,868,469 A 2/1999 Ming
5,887,947 A 3/1999 Chi
6,017,089 A 1/2000 Mengshoel
6,276,756 B1 * 8/2001 Cho et al. ..... 297/344.19
6,318,801 B1 11/2001 Tkafuji
6,382,716 B1 5/2002 Wu
6,692,076 B1 * 2/2004 Burer ..... 297/331
2002/0021037 A1 2/2002 Alexander, Jr.
2003/0184131 A1 10/2003 Haney

* cited by examiner

*Primary Examiner*—Peter M. Cuomo
*Assistant Examiner*—Sarah B. McPartlin
(74) *Attorney, Agent, or Firm*—Kenneth W. Iles

(57) ABSTRACT

A folding chair has a height adjustable seat whose height is controlled by a pneumatic cylinder having locking springs is seated inside each of the two tubular front legs of the chair. A trigger mechanism allows the user to release the locking aspect of the springs, adjusting the height of the seat before locking the spring length again. The chair is supported by a pair of cylindrical sleeves that move up and down the front legs and that are connected by a seat stop bar that maintains the seat in a position ready for use because it is contacted by the straight rear edge of a pair of gussets connected to the sides of the seat. The chair seat pivots upward into a storage position through a pair of hollow pins connected to fittings at the top of the pneumatic cylinders and that move up and down the front legs within an elongated slot cut into each front leg.

16 Claims, 5 Drawing Sheets

FOLDING CHAIR WITH PNUEMATICALLY HEIGHT ADJUSTABLE SEAT

CROSS-REFERENCE TO RELATED APPLICATIONS

Not Applicable.

STATEMENT REGARDING FEDERALLY SPONSORED RESEARCH OR DEVELOPMENT.

Not applicable.

BACKGROUND OF THE INVENTION

The present invention is related to a folding chair. More particularly, the present invention is related to a folding chair having a height adjustable seat. The height of the seat is preferably adjusted through use of a pneumatic cylinder.

DESCRIPTION OF THE RELATED ART INCLUDING INFORMATION DISCLOSED UNDER 37 C.F.R. 1.97 and 1.98.

Folding chairs have been developed to save space when they are not in use. Most folding chairs have a fixed geometry and seat and back height when they are unfolded for use. The use of a fixed seat height represents a compromise that leaves the typical folding chair uncomfortable for users whose height deviates from the norm by any significant amount.

Some efforts have been made to develop a chair with a height adjustable seat. For example, U.S. Pat. No. 6,318,801, discloses a Structure for Supporting Seat of Height-Adjustment Chair comprising a bracket that holds the chair seat and that grips the front of an upright side supporting frame at one point and that grips the rear of the supporting frame at another higher point, thereby exerting torque on the upright side supporting frame and using this torque to maintain the position, i.e., the height of the chair seat. Lifting upward on the front edge of the seat disengages the bracket from the supporting frame, allowing the user to raise or lower the seat by hand. Allowing the seat to tilt forward re-engages the seat brackets into the upright side supporting frame, securing the seat at its newly adjusted height. A chair having a single upright side supporting member 1 in the form of a U-shaped member may be used or a more conventionally appearing chair having a pair of parallel frame supports may be used There are not pneumatic or other mechanical motive devices. The user simply raises or lowers the seat as desired. A number of patents have been issued for similar structures, but these are not folding chairs and consequently occupy the same amount of floor space whether or not they are in use. Further, adjusting the height of the seat in such chairs is awkward and requires substantial manipulation of the chair by the user.

U.S. Pat. No. 5,740,997 discloses a Pneumatic Height Adjustment Column for a Chair having a pneumatic cartridge that forms a portion of a central upright side chair support and that permits adjustment of the seat height by a lever that depresses a switch 33 to release pressure and permit adjustment of the seat height. Releasing the lever locks the chair seat into the desired height position (FIGS. 1, 2). This is one of many patents for desk-type height-adjustable chairs and illustrates the use of pneumatic cylinders for height adjustment in chairs, but such structures are not conducive to use with folding chairs and hence suffer from the same drawback as the above referenced type of chairs, namely they occupy the same amount of floor space whether in use or not and are therefore not easily stored or easily portable.

U.S. Pat. No. 5,667,274 discloses an Adjustable Chair in which both the height of the seat and the height of the chair back can be adjusted. The height of the seat is adjusted by lengthening the rear seat supporting frame members and the height of the backrest is adjusted by changing the length of the front leg supports, which project rearwardly and upwardly to form a frame for the backrest. In both cases, the adjustments are made by removing a pin from aligned apertures, sliding the telescoping members in or out, realigning selected apertures in the telescoping members and reinserting the pin. Adjustment of the seat height of this type of chair is awkward and in the chair cannot be folded for storage or transport.

Examples of typical folding chairs are found in U.S. Pat. No. 6,382,716 and United States Patent Application Publication Number U.S. 2003/0184131, but, as is the case in all folding chairs known to applicant, no height adjustment of the seat is possible.

People who are very tall or very short cannot use conventional folding chairs comfortably. In addition, some people prefer to take their own chair with them when they travel, particularly if it is more comfortable than the chairs they are likely to find out at their destination. In one case for example, professional basketball players tend to be exceptionally tall and cannot be comfortably seated in a conventional folding chair. Further, even among such a tall population as basketball players, there are substantial height variations, making a chair having a single fixed-position seating height unsuitable for all members of the entire population. To serve a population of widely varying heights well, the height of the seat should be infinitely adjustable throughout the full range of height adjustment. In addition, adjusting the height of the seat should be easy.

Therefore, a need exists for a folding chair having a height-adjustable seat; whose seat is infinitely adjustable throughout its range of adjustment; and that is easy to adjust.

BRIEF SUMMARY OF THE INVENTION

Accordingly, it is a primary object of the present invention to provide a folding chair having a height-adjustable seat.

It is a further object to the present invention to provide a folding chair whose seat can be infinitely adjusted throughout its range of adjustment.

It is a further object of the present invention to provide a folding chair having a seat whose height is easily adjusted.

To achieve these and other objects at the present invention, there is provided a folding chair having a frame with a pair of opposed parallel tubular front legs and a pair of opposed parallel rear legs joined by a floor brace, with a backrest fixed to the upper ends of the front legs and a seat that slides up and down along the lower portion of the front legs, whose height can be adjusted by releasing the pressure in a pneumatic cylinder by using a trigger mechanism, thereby allowing the user to slide the seat up or down within a certain range of movement along the front legs. Releasing the trigger locks the seat into the position set. The chair can be folded in the same fashion as a conventional folding chair.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
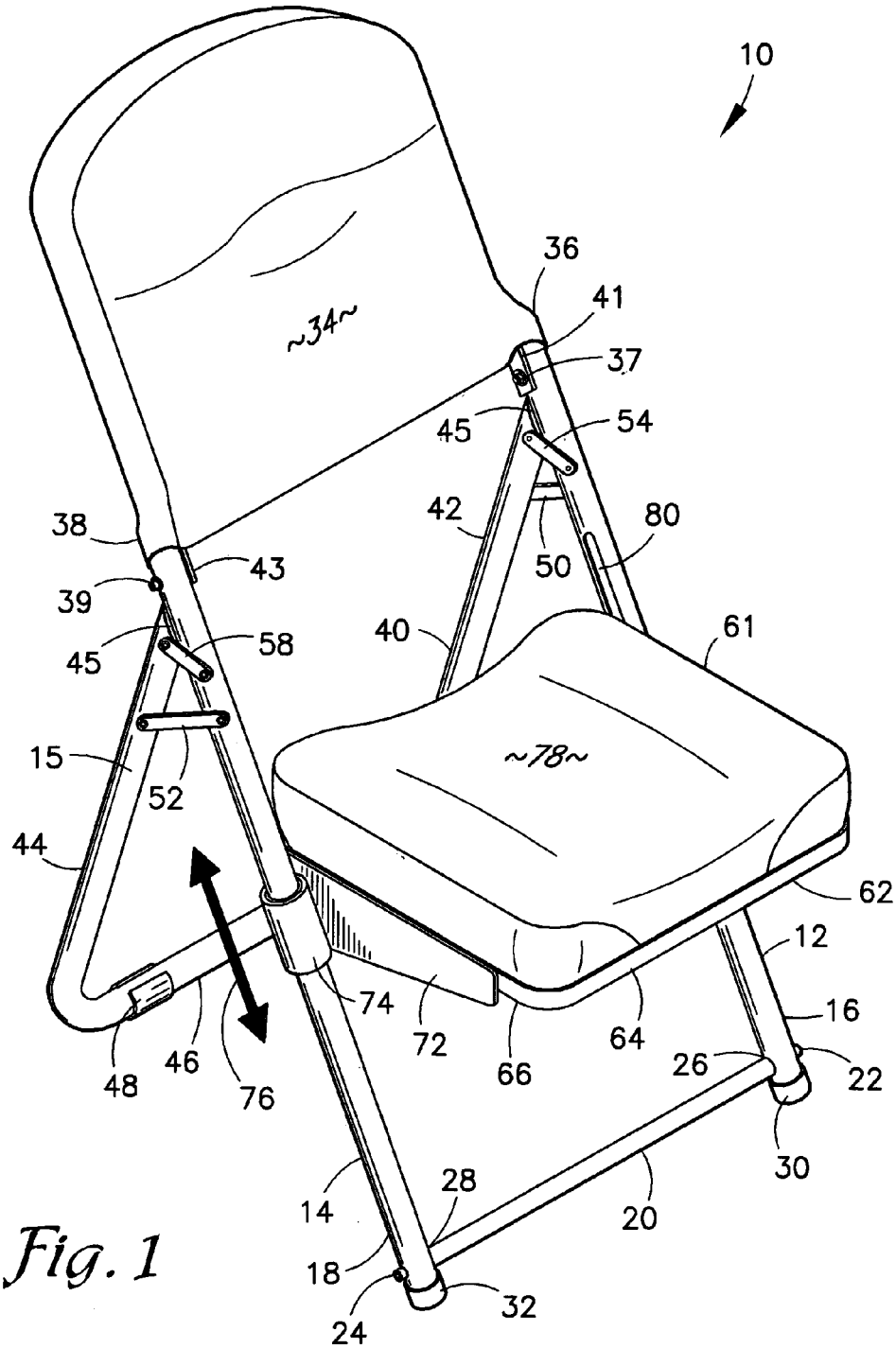
FIG. 1 is right side-hand front isometric view of a folding chair with pneumatically height-adjustable seat according to the present invention, shown in the open position ready for use as a chair.

Referring to FIG. 1, a folding chair with pneumatically height-adjustable seat, or folding chair, or chair 10, includes a left side front leg 12 and a right side front leg 14, each having a lower end 16, 18, respectively. A cross brace 20 is connected to the lower ends 16, 18 of the left side front leg 12 and the right side front leg 14 by inserting a rod 22 through the left leg 12, the cross brace 20 and the right leg 14 and securing the rod with a socket head cap screw 24 threaded into the end of the rod 22. The rod 22 also passes through an aperture in fittings in pneumatic cylinders seated within each leg 12, 14, as discussed in connection with FIG. 3 below. An end cap 30 is placed over the lower end of the left side front leg 12 and an end 32 is placed over the lower end of the right side front leg 14. The end caps 30, 32 may be made of any suitable soft resilient, such as rubber or plastic and are intended to protect the finish on a floor and to prevent the chair legs from gouging otherwise marring the floor. The tubular front legs 12, 14, the rear legs 42, 44 and the fitting that fasten them together collectively form a chair frame 15. The orienting terms left side and right side or left side-hand and right side-hand, in front and rear are used in their ordinary sense and refer to the directions relative to a person seated in the chair. The orienting term inside refers to a part that is placed within the outer lines formed by the chair and back and the orienting term outside refers to parts placed outside those lines.

Still Referring to FIG. 1, a backrest 34 is connected to the upper ends of the front legs 12, 14, by inserting the upper ends of the front legs 12, 14, which both include an upper portion, into the left side cylindrical pocket 36 and the right side cylindrical pocket 38 on the respective right side-hand and left side-hand side edges of the backrest 34 in a conventional manner. The backrest 34 is fixed to the front legs 12, 14 at or adjacent to the points 16, 18 by inserting the screws 37, 39, respectively through apertures in two depending tab members 41, 43, which project downwardly from the pockets 36, 38, respectively. The backrest 34 is fixed to the front legs at the points 16, 18 and, in conjunction with the cross brace 20, maintains the front legs 12, 14 in a fixed parallel relationship. The backrest 34, and the seat (discussed below) may be of any desired thickness, size, and so forth and may utilize any desired covering, such as leather, fabric or the like and may be padded for comfort. The backrest 34 and the seat preferably have matching coverings and general shapes.

Still referring to FIG. 1, U-shaped leg and brace member 40 formed from a single piece of material provides a brace for keeping the folding chair in an upright side when it is in the unfolded position, by providing a left side rear leg 42 and a right side rear leg 44 joined along their bottom by a floor brace member 46. The upper ends of each rear leg 42, 44 are cut off at an angle of about 60° to the axis of the tubular legs so that the resulting line, which is somewhat curved as it passes along the circumference of the tubular legs 42, 44, fits flush against the rear surface of the front legs 12, 14 at the junction line 45 when the legs of the folding chair 10 are fully unfolded, thereby providing support for transmitting rearward forces to the floor or ground.

Figure 4:
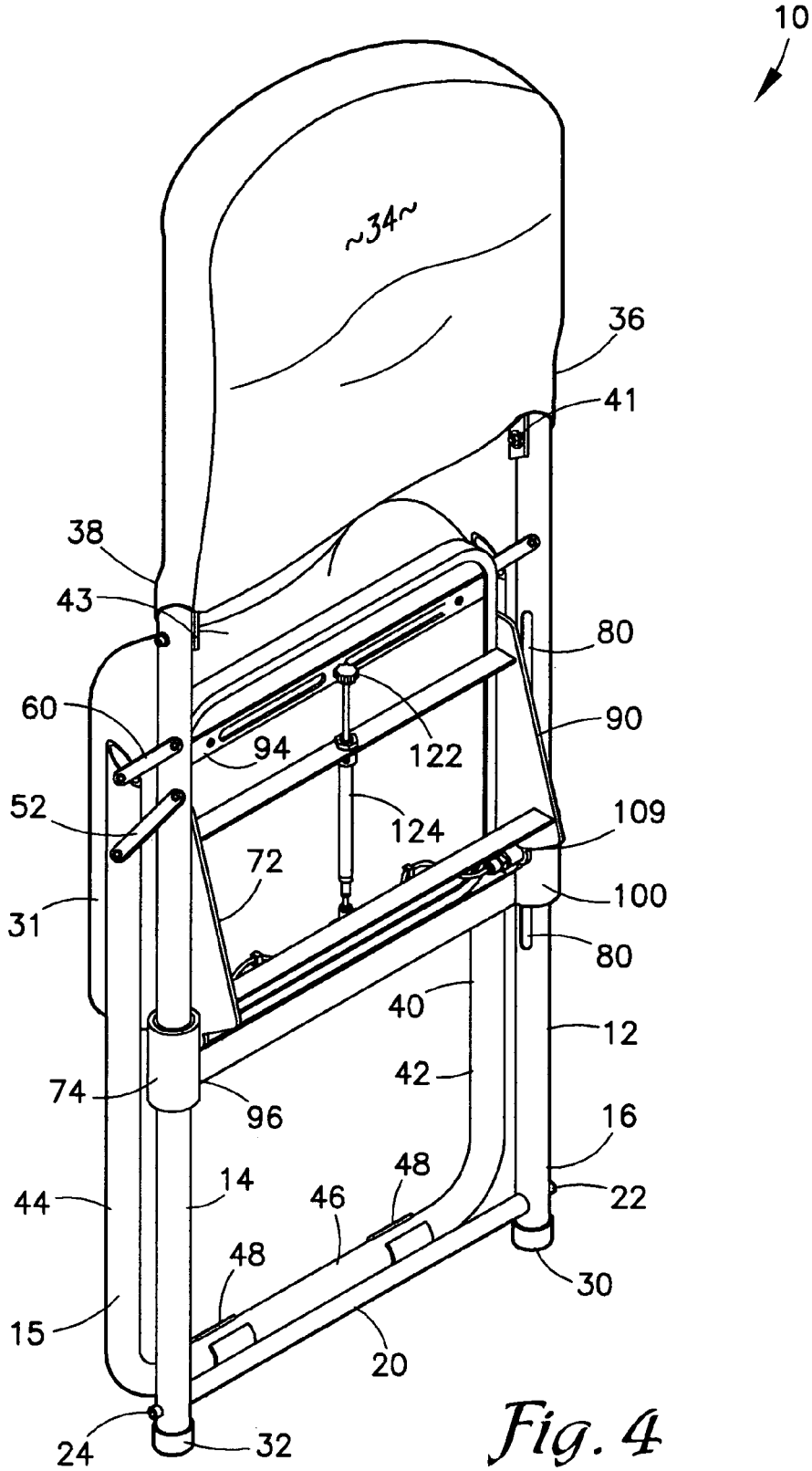
FIG. 4 is an isometric view of the folding chair with pneumatically height-adjustable seat of FIG. 1 showing the folding chair with pneumatically height-adjustable seat in the folded position ready for storage.

Still referring to FIG. 1, two spaced cushioning sleeves 48 are snapped over the floor brace member 46 and are made of plastic, rubber or the like designed to prevent marring the floor. The rear legs 42, 44 are pivotally connected to the upper ends of the front legs 12, 14 by a primary pivot members, which are the left side primary pivot member 50 and the right side primary pivot member 52, and the secondary pivot members, which are the left side secondary pivot members 54, 56 in the right side secondary pivot members 58, 60. The secondary pivot members are shorter than the primary pivot members and the secondary pivot members are provided in matched pairs in spaced parallel relationship on either side of the leg members to which they are fastened, so that not all secondary pivot members are visible in FIG. 1. Each of the pivot members comprises an elongated flat bar member having two ends with an aperture in each end, which is pivotally connected to a leg of the folding chair 10. The folding chair 10 defines a more compact form for storage or transport when it is folded, as shown in FIG. 4.

Still referring to FIG. 1, a seat 61 include a seat frame 62, which further includes a front frame member 64, a right side seat frame member 66, a rear seat frame member 68 (FIG. 3), and a left side seat frame member 70 (FIG. 2), all of which are joined together to form a square seat frame 62 and which may be made from a single length of steel bar stock bent into the square, with the two ends of the bar stock welded or otherwise fastened together. A roughly trapezoidal-shaped right side gusset 72 is fixed to the right side seat frame member 66 with the wider portion of the shape lying adjacent to the rear of the seat frame 62. A right side reciprocating sleeve 74 is slipped over the right side front leg 14 during assembly of the folding chair 10 and reciprocates up and down the front leg 14 during height adjustment of the seat 61 in the directions of the double-headed arrow 76. A seat cushion 78 is fastened to the seat frame 62 by screws or other fasteners. An elongated narrow left side adjustment slot 80 is formed along the inner side of the left side leg 12 to accommodate the height-adjustment mechanism, discussed below in regard to FIG. 3.

Figure 2:
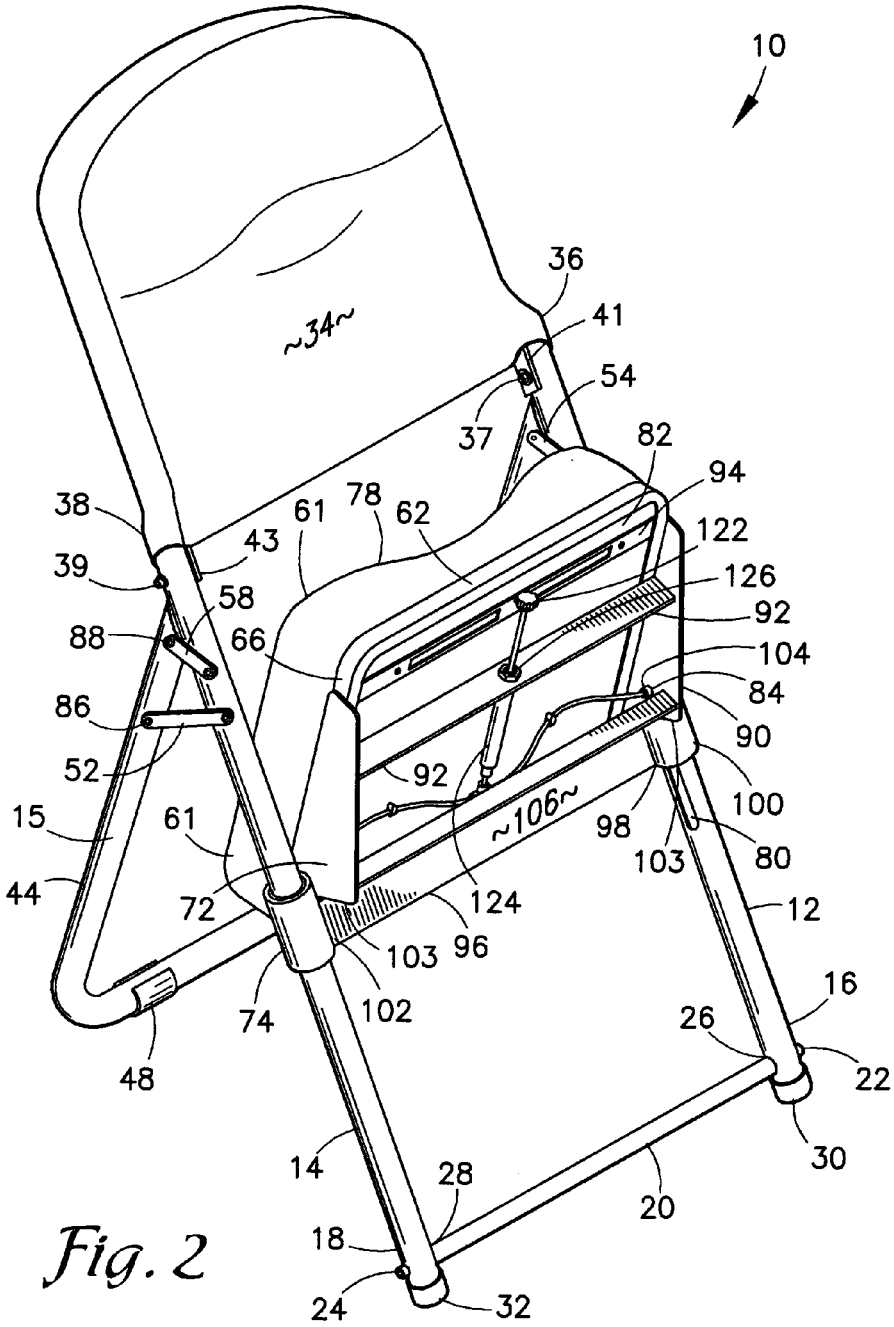
FIG. 2 a right side-hand front isometric view of the folding chair with pneumatically height-adjustable seat of FIG. 1 shown partially folded and exposing the trigger mechanism for adjusting the seat height.

Referring to FIG. 2, when the folding chair 10 is to be folded, the seat 61 is moved to its lowest adjustment position and the front edge 82 of the seat 61 is pushed forward, thereby rotating the seat along its pivot axis 84 and moving the front edge 82 of the seat 61 toward the backrest 34. Then the rear legs 42, 44 are pushed inward toward the front legs 12, 14, causing the right side primary pivot member 52 to move downwardly at its rear end 86 while the rear and 88 of the secondary pivot member 58 moves downwardly. The secondary pivot members 58 (FIG. 2), 60 (FIG. 4) on the inside and outside of the right side leg 14, move in exactly the same fashion. At the same time, the corresponding pivot members connected to the left side leg 12, that is left side primary pivot number 50, and secondary pivot members 54, 56, rotate in a similar fashion, allowing the rear leg frame 42 to collapse against the front legs 12, 14, as shown in FIG. 4. To unfold the folding chair 10 into the position shown in FIG. 1, that is, ready for use, the user merely reverses the procedure used to fold the folding chair 10 by pulling outwardly on the U-shaped rear leg and brace member or frame 40. Prior to folding the folding chair 10 into the configuration shown in FIG. 4, the seat 61 must be lowered to its lowest height to provide the most compact folded form.

Still referring to FIG. 2, a central cross member brace 92 runs between the inside surfaces of the right side gusset 72 and the left side gusset 90 is fastened to the respective gussets by welding or the like. A strap seat brace 94 is fastened to the underside of the seat cushion 78. A seat 61 stop bar member 96, which is preferably a length of metal bar stock, includes a left side end 98 connected to the left side reciprocating sleeve 100 and a right side end 102. Each gusset 72, 90 includes a straight rear edge 103, that strikes the front surface 106 of the stop bar member 96, with the rear edges in contact with the stop bar member 96 throughout their entire lengths, when the seat 61 is pushed down into the position for use. The seat 61 pivots up and down along an axis adjacent to a rear portion of the seat 61 about an axis defined by two hollow seat pivot pins 104 that are fixed into the gussets 72, 90 through the aperture 105 (shown in FIGS. 3, 4) in each gusset 72, 90 and into the aperture in the left front leg 12 (FIG. 4) and the narrow elongated slot 110 (FIG. 6) in the right front leg 14 (FIG. 3), respectively. The hollow seat pivot pins 104 are fixed relative to the gussets 72, 90 but rotate with respect to the front legs 12, 14. The hollow seat pivot pins also pass through the apertures 109 in the left side reciprocating tubular sleeve 100 and the right side reciprocating tubular sleeve 74, which are connected by welding or the like to the stop bar member 96, thereby insuring that the tubular sleeves 74, 100 and the stop bar member 96 move up and down along with the seat 61 when the height of the folding chair 10 is adjusted. The hollow seat pivot pins 104 (FIG. 3) are hollow to permit the transmission of pneumatic fluid and are in fluid communication with a switch mechanism on the top of each pneumatic cylinder 112, which is actuated to release pressure inside the pneumatic cylinders 112 and to fix the rods 114 into a new length setting and thereby to operate the height-adjustment mechanism, as described below. The hollow pivot pins 104 reciprocate up and down within the aligned opposing left side elongated narrow slot 80 in the left front leg 12 and the right side elongated narrow slot 110 in the right side front leg 14 (FIG. 6), which are identical in shape, size, and are placed opposite of each other on their respective front legs 12, 14, allowing the seat 61 to move up and down as adjusted by the user.

Figure 3:
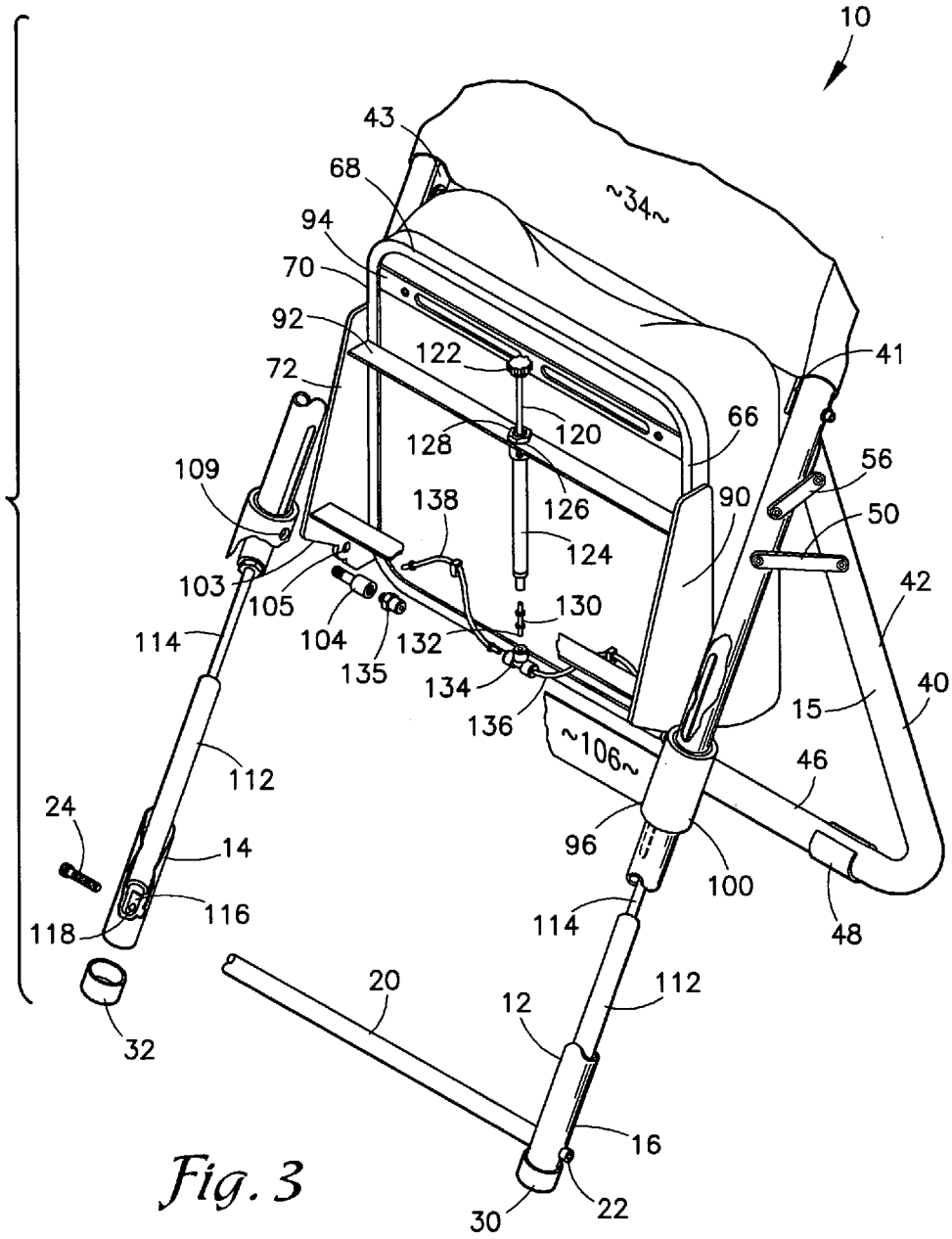
FIG. 3 a fragmentary rear isometric view of the folding chair with pneumatically height-adjustable seat of FIG. 1, partially broken away and showing the pneumatic cylinder and the parts of the trigger mechanism.
Figure 5:
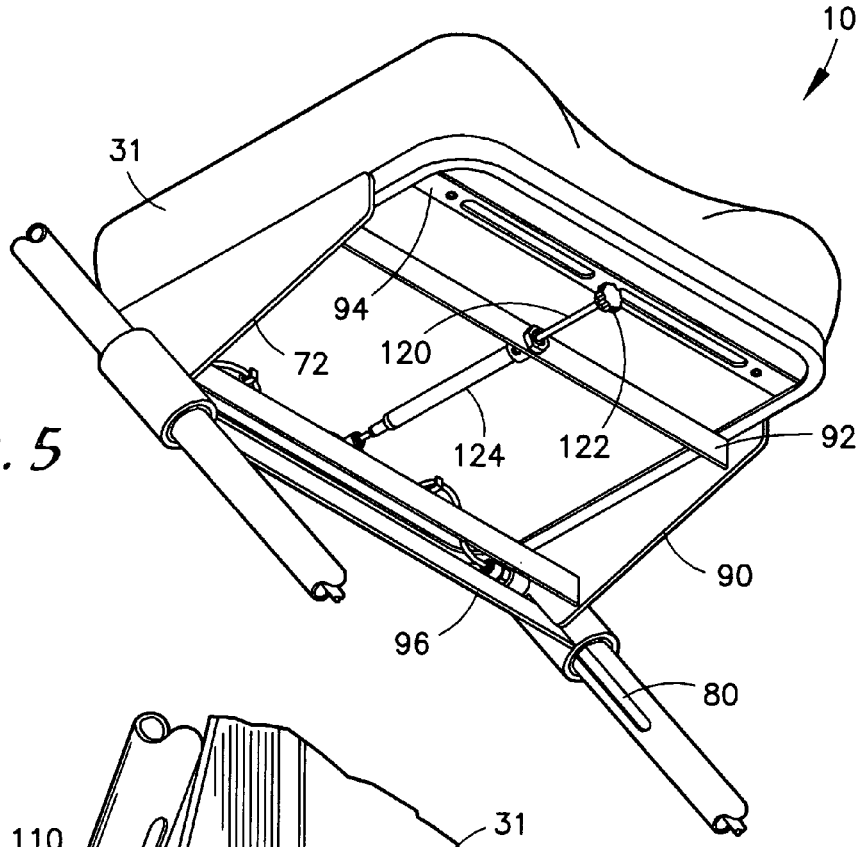
FIG. 5 is a fragmentary isometric view showing the underside of a seat of the folding chair with pneumatically height-adjustable seat of FIG. 1 showing the seat pivoted downwardly into the position used for sitting.
Figure 6:
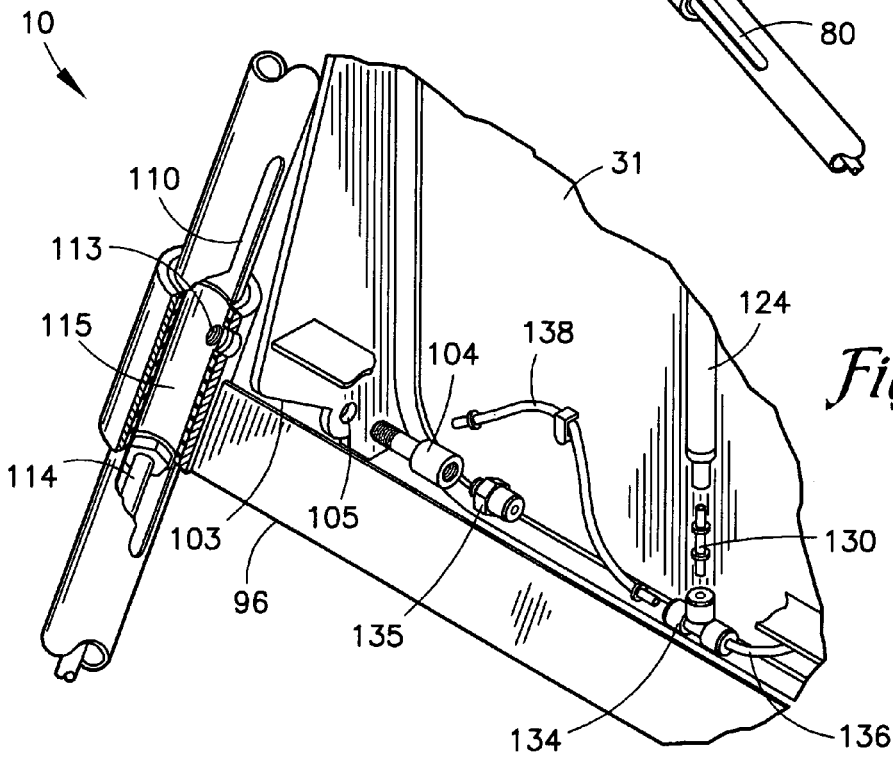
FIG. 6 is a fragmentary isometric view showing the underside of a seat of the folding chair with pneumatically height-adjustable chair of FIG. 1 showing the seat pivoted upwardly into the position used for storing the folding chair of FIG. 1.

Referring to FIGS. 3, 5, 6, the adjustment and chair height setting mechanism includes a pneumatic cylinder 112 in each front leg 12, 14, capable of developing pneumatic pressure to support a column at a desired height, within its range of motion, means for selectively releasing that pressure and storing the resulting pneumatic fluid flow outside the main cylinder, allowing the user to set the height of the rod 114 and then locking the rod 114 into the desired position. Each pneumatic cylinder 112 includes a lower end having a depending lug 116 having an aperture 118 (FIG. 3) through it, and the elongated bolt 22 passes through each of the apertures 118 in the lug 116, securing the lower ends of the pneumatic cylinders 112 to the lower ends 16, 18 of the front legs 12, 14, respectively. The pins 104 include a threaded end that is screwed into a threaded bore 113 (FIG. 6) in a control fitting 115 (FIG. 6) at the top of each pneumatic cylinder 112, with the control fitting providing fluid communication to the pneumatic cylinder 112 and, at the same time, structural support to the seat 61, which is sufficient to support the seat 61 and a seated person on the seat 61, in connection with the support provided by the rear edges of the gussets 72, 90 contacting the seat stop member 96. The pneumatic air spring cylinders 112 are employed for raising and lowering the seat 61 relative to the chair frame 15 of the folding chair 10 in infinitely fine adjustments throughout a predetermined adjustment range.

Still referring to FIG. 3, actually adjusting the height of the folding chair 10 utilizes a pneumatic fluid control mechanism that includes a trigger plunger 120. A trigger plunger rod 120 has a knob 122, which is preferably a stainless steel double acting air cylinder well known in the art, connected to its distal end, and is fastened into the trigger plunger cylinder 124, which is fixed to the central cross brace 92 by inserting a threaded fitting on the trigger plunger cylinder 124 though the aperture 126 in the stop bar member 96 and securing it in place with the nut 128. One end of a straight nipple fitting 130 is secured to the lower end 132 of the trigger plunder cylinder 124 and the other end of the straight nipple fitting 130 is inserted into a T-fitting 134 that communicates pneumatic pressure to the left and right through the left side tube 136, which is secured to the T-fitting 134 at one end and to the left side hollow seat pivot pin 104, through the fitting 135 at the other end and a right side tube 138 that is secured to the T-fitting 134 at one end and to the right side seat pivot pin 104 at the other end, through a fitting 135. The hollow seat pivot pins 104 are secured directly into a fitting at the top of each of the pneumatic cylinders 112, which permits fluid communication with the pneumatic cylinders 112 to control the pressure within the pneumatic gas spring cylinders 112. Pulling or pushing on the trigger plunger 120 releases the pressure inside the pneumatic cylinders 112 that maintains the rods 114 in the desired position, allowing the length of the rods 114 that projects from the pneumatic cylinders 112 to be adjusted as desired. The trigger plunger 120 can be configured to release pressure in the pneumatic cylinders either by pushing or by pulling, as desired. A piston inside the trigger plunger cylinder 124 develops pneumatic pressure that is communicated throughout the triggering mechanism described here, which is filed with pneumatic fluid. Releasing the trigger plunger 120 locks the length of the rods 114 of the pneumatic cylinders 112 into the desired position, that is, length, and thus determines the height of the seat 61.

The pneumatic cylinders 112 are locking compression springs, also called gas springs, that are similar to the ones found in common office chairs. "Unlocking" means that the internal spring can be locked into any position and compression means that the an internal spring will push outward and expand when unlocked. A locking spring with any desired stroke can be used, but preferably, a looking spring with a 25 cm (10 inches) stroke and a pushing force of about 16 kilograms (35 lbs.) is used in the preferred embodiment. This stroke length moves the folding chair 10 seat 61 from the lowest desired position to the highest desired position. The springs within the pneumatic air spring cylinders 112 need to compress when the user is setting on the folding chair 10, which causes the seat 61 to be lowered. The springs also need to extend when the user is not setting on the chair which will cause the seat 61 to rise somewhat. Such pneumatic or gas springs and triggering mechanism are readily available commercially and so will not be described in detail here. Alternatively, hydraulic cylinders having a similar capability can be used.

Referring to FIG. 4, the folding chair 10 is shown fully folded ready for storage or transport. The folding chair 10 is easily portable when folded and is designed to handle seating load of at least 160 Kilograms (350 pounds). The front legs 12, 14, and rear legs 42, 44 and braces are preferably made from steel tubes and the seat frame is preferably made from steel, but all parts can be made from any other suitable material, such as aluminum, titanium, or the like, which reduces the weight of the folding chair 10.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. A chair comprising:

a. a frame having a pair of opposed parallel front legs;

b. a pair of opposed parallel rear legs connected to said opposed parallel front legs;

c. a seat connected to said frame; and d. means for raising and lowering said seat relative to said frame in infinitely fine adjustments throughout a predetermined adjustment range, said raising and lowering means further comprising at least one pneumatic cylinder connected to at least one front leg, said chair further comprising a slot in at least one said front leg, said at least one pneumatic cylinder disposed and fixed into said at least one front leg and means for supporting said seat connected to said seat and to an upper end of said at least one pneumatic cylinder with said seat supporting means projecting through said slot.

2. A chair in accordance with claim 1 further comprising means for folding said chair into a generally flat configuration whereby said chair defines a more compact form for storage or transport.

3. A chair in accordance with claim 1 wherein said chair further comprises means for pivoting said seat up and down along an axis adjacent to a rear portion of said seat.

4. A chair in accordance with claim 1 further comprising means for connecting said seat to said pneumatic cylinder.

5. A chair in accordance with claim 1 further comprising an air cylinder trigger means connected to said at least one pneumatic cylinder for releasing pressure in said at least one pneumatic cylinder, thereby allowing height adjustment of said seat.

6. A chair in accordance with claim 1 wherein said front legs further comprise an upper portion having a backrest connected to said upper end of said front legs.

7. A chair in accordance with claim 1 further comprising means for supporting said seat at a predetermined height.

8. A chair in accordance with claim 1 wherein said seat supporting means further comprises a tubular sleeve installed over each said front leg and connected together by a seat stop bar member.

9. A chair in accordance with claim 8 wherein said seat supporting means further comprises a gusset fixed to a seat frame of said seat, with one said gusset adjacent to each said front leg and each said gusset having a flat rear edge that contacts said seat stop bar member.

10. A chair comprising:

a. a frame having a pair of opposed parallel front legs;

b. a pair of opposed parallel rear legs connected to said opposed parallel front legs;

c. a seat connected to said frame;

d. means for raising and lowering said seat relative to said frame in infinitely fine adjustments throughout a predetermined adjustment range; and e. means for folding said chair into a generally flat configuration whereby said chair defines a more compact form for storage or transport; and f. said chair further comprising a slot in each said front leg, with said slots opposite from one another and opposed to one another, at least one pneumatic cylinder disposed and fixed into at least one said front leg and means for supporting said seat connected to said seat and to an upper end of said at least one pneumatic cylinder with said seat supporting means projecting through said slots.

11. A chair in accordance with claim 10 further comprising a means for supporting said seat comprising a tubular sleeve installed over each said front leg and connected together by a seat stop bar member.

12. A chair in accordance with claim 11 further comprising means for supporting said seat comprising a gusset fixed to a seat frame of said seat, with one said gusset adjacent to each said front leg and each said gusset having a flat rear edge that contacts said seat stop bar member.

13. A chair comprising:

a. a frame having a pair of opposed parallel tubular front legs;

b. a pair of opposed parallel rear legs connected to said opposed parallel front legs;

c. a seat pivotally connected to said frame;

d. means for raising and lowering said seat relative to said frame in infinitely fine adjustments throughout a predetermined adjustment range, said raising and lowering means further comprising a pneumatic cylinder disposed inside of and connected to each said tubular front leg, and a slot in each said front leg, with said slots opposite from one another and opposed to one another, and means for supporting said seat connected to said seat and to an upper end of each said pneumatic cylinder with said seat supporting means projecting through said slots; and e. means for folding said chair into a generally flat configuration whereby said chair defines a more compact form for storage or transport.

14. A chair in accordance with claim 13 further comprising a tubular sleeve installed over each said front leg and connected together by a seat stop bar member and two spaced apart parallel gussets fixed to a seat frame of said seat, with one said gusset adjacent to each said front leg and each said gusset having a flat rear edge that contacts said seat stop bar member when said seat is in the position used for seating.

15. A chair in accordance with claim 14 further comprising pivoting means for connecting one said gusset to said tubular sleeve and to a control switch on the top of each said pneumatic cylinder on each of a left side and a right side of said chair.

16. A chair in accordance with claim 1 wherein said seat supporting means further comprises a hollow pin in fluid communication with a switch mechanism on each said pneumatic cylinder.

* * * * *